United States Patent [19]

Böcker

[11] Patent Number: 4,703,696

[45] Date of Patent: Nov. 3, 1987

[54] PENETRATOR FOR A SUBCALIBER IMPACT PROJECTILE

[75] Inventor: Jürgen Böcker, Oberhausen, Fed. Rep. of Germany

[73] Assignee: Rheinmetall GmbH, Dusseldorf, Fed. Rep. of Germany

[21] Appl. No.: 295,552

[22] Filed: Jul. 27, 1981

Related U.S. Application Data

[63] Continuation-in-part of Ser. No. 213,172, Nov. 26, 1980, abandoned.

[30] Foreign Application Priority Data

Dec. 1, 1979 [DE] Fed. Rep. of Germany ..... 2948375

[51] Int. Cl.[4] ..... F42B 11/00

[52] U.S. Cl. ..... 102/517; 102/501; 102/521; 102/491

[58] Field of Search ..... 102/501, 514–523, 102/438, 439, 489, 491, 4194, 495, 496

[56] References Cited

U.S. PATENT DOCUMENTS

| | | | |
|---|---|---|---|
| 631,703 | 8/1899 | Dunn | 102/494 |
| 1,305,967 | 6/1919 | Hawks | 102/494 |
| 1,892,152 | 12/1932 | Jones | 102/518 |
| 3,599,573 | 8/1971 | Silney | 102/517 |
| 3,877,380 | 4/1975 | Riparbelli | 102/519 |
| 4,036,141 | 7/1977 | Korr | 102/438 |
| 4,044,679 | 8/1977 | Pagano et al. | 102/517 |
| 4,123,975 | 11/1978 | Mohaupt | 102/518 |
| 4,301,737 | 11/1981 | Yuhash | 102/518 |
| 4,323,012 | 4/1982 | Driver, Jr. | 102/489 |
| 4,353,305 | 10/1982 | Moreau et al. | 102/519 |

FOREIGN PATENT DOCUMENTS

| | | | |
|---|---|---|---|
| 573914 | 12/1945 | United Kingdom | 102/518 |

*Primary Examiner*—Harold J. Tudor
*Attorney, Agent, or Firm*—Karl F. Ross; Herbert Dubno

[57] ABSTRACT

A penetrator for a subcaliber impact or inertial projectile, especially a projectile adapted to pierce or break an armored target, which comprises a core of comparatively high density within a metallic housing or shell and in which the core is subdivided along a longitudinal axis into at least two core parts with the core parts being encased in respective sheaths which prevent transmission of cracks from one part to another, a spacing being formed between the parts by at least one sheath and having a thickness corresponding at least to the thickness of one sheath.

10 Claims, 4 Drawing Figures

PENETRATOR FOR A SUBCALIBER IMPACT PROJECTILE

CROSS REFERENCE TO RELATED APPLICATION

This application is a continuation-in-part of my copending application Ser. No. 213,172 filed Nov. 26, 1980 now abandoned.

FIELD OF THE INVENTION

My present invention relates to impact or inertial projectiles of armor-piercing or armor-breaking type and, more particularly, to a penetrator for an impact or inertial projectile adapted to penetrate the armor of a military vehicle such as a tank, armored personnel carrier or armored artillery unit.

BACKGROUND OF THE INVENTION

For military applications it is known to provide so-called impact or inertial projectiles, i.e. projectiles which may be self-propelled or fired from a barrel-type weapon such as a cannon, which comprise at least one core of high-density metal adapted to function as a penetrator or armor-breaking or armor-piercing element.

The penetrator, which functions because of its high kinetic energy on impact with the armor to pierce or damage the latter without the use of an explosive, can be carried on or form part of a projectile having a plurality of such cores (see the commonly assigned copending application Ser. No. 949,067 filed 5 Sept. 1978, now abandoned but replaced by Ser. No. 412,794 of Aug. 23, 1982 the cores being designed to pierce the armor in succession.

An impact or inertial projectile differs from an active-head projectile in that the latter generally carries an explosive charge which detonates as the projectile contacts or approaches the target whereas the former utilizes merely its kinetic energy to penetrate the armor wall.

Multi-core penetrators as described in the aforementioned copending application can be used when the armor of the target is multilayer or laminated armor (a so-called multiple target or structured target) in which case the successive engagement of cores with the armor permits penetration through successive layers and hence effective penetration into the vehicle or through the armor wall.

The core is, as noted, of a high-density hard metal and generally is surrounded by a shell which may be the casing of the projectile.

Behind the penetrator, the projectile may be provided with additional impact or inertial cores or with activatable charges which function once the projectile has penetrated the armor by explosion to destroy the target.

The high-density core of the penetrator, when surrounded by a lower-density metallic shell or casing, forms a penetrator of a median density, i.e. a density which is a weighted average of the densities of the core and the surrounding envelope of lighter metal.

This average density, of course, should be as high as possible since the penetration of the device is a function of the kinetic energy which, in turn, is a function of mass and the greater the density, the greater the mass for a given volume of the penetrator.

It is desirable that the mass be as large as possible of the core and this can be ensured by making the core elongated for a given diameter of the projectile so that the ratio of the length to the diameter of the core is relatively large. Such relatively elongated cores have been found to be especially effective against multilayer armor.

However, problems have been encountered when elongated cores were used.

For example, the cores are generally formed from a high-density hard material, e.g. tungsten, which is difficult to machine and hence the cores are formed by sintering and like powder-metallurgical techniques. It has been found that when such cores engage the target and even when such cores are accelerated from the barrel of the weapon on firing of the projectile, they tend to crack transversely to their longitudinal dimension.

Such cracks can develop as a result of bending stresses applied during fabrication, assembly, firing or impact and are rapidly propagated through the core because the hard materials from which cores are made are generally relatively brittle so that the cracks customarily extend over the full cross section.

This results in a breakup of a core into pieces of small length and defeats the effort to provide a large length-to-diameter ratio.

In some cases, the number of cracks and the degree of fragmentation of the core are so great that the penetrator totally loses its effectiveness or, at best, has significantly reduced penetration against multilayer targets.

OBJECTS OF THE INVENTION

It is the principal object of the present invention to provide an improved impact or inertial projectile whereby disadvantages of earlier systems are obviated.

Another object of the invention is to provide a penetrator for such a projectile which is less susceptible to loss of penetrating power with cracking of the penetrator cores.

SUMMARY OF THE INVENTION

These objects and others which will become apparent hereinafter are attained, in accordance with the present invention in a penetrator for a subcaliber impact or inertial projectile, especially a projectile adapted to attack armored targets and particularly multi-layer armor, and in which the core of the penetrator is subdivided along a longitudinal axis into at least two core parts or partial cores separated by at least one intervening layer and held at a predetermined distance from one another by this layer.

According to a feature of the invention, this layer is formed by a sheath of metal surrounding at least one of the core parts and preferably surrounding both of the core parts while being interposed between them. When separate sheaths are provided for the core parts, the separation of the two core parts transverse to the axis may be equal to the sum of the thicknesses of the sheaths which surround the core parts and contact each other. When, however, the sheaths of the core parts form individual compartments in which the core parts are disposed but are unitary or in one piece with one another, the separation thickness may be equal to the wall thickness of the sheaths about each core part.

According to another feature of the invention, the material of the intervening layer corresponds to the material of the shell or casing surrounding the core of the penetrator although it is also contemplated within the invention that the material of the intermediate layer can differ from that of the shell or casing. In the first case, the sheaths can be formed unitarily with the casing material.

According to yet another feature of the invention, the casing or shell is composed of a material which is more ductile and tougher than the material of the core, i.e. the hard metal surrounded by the sheath, which, in turn, may be more ductile and tougher than the material of the core as well.

The material of the casing or shell should have a strength-loss temperature which differs from that of the core and is advantageously lower than the strength-loss temperature of the core.

The material of the sheath and heads of the interposed layer can have a strength-loss temperature different from that of the core and preferably lower than that of the core as well.

With the system of the present invention, in which the core parts are preferably circular-cross-section rods or cylindrical-segmental bars, it is found that the development of a crack in one of the core parts does not pose a significant problem because this crack cannot be transmitted over the full cross section of the penetrator. Rather, the crack can only run until it meets the sheath or the boundary or surface of the core part.

The cracks are not propagated from one core part to another core part and hence the penetration of the device remains high in spite of cracks here and there in the various core parts.

The application of the additional sheath or the interposition of a separating layer between the core parts has not been found to create any significant disadvantage even though it slightly reduces the mean density of the penetrator. In other words this slight reduction in mean density does not significantly reduce the penetration capability of the device.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
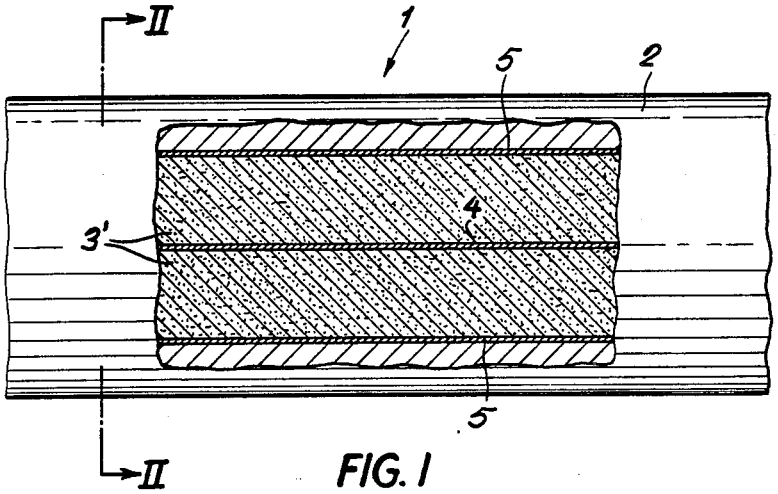
FIG. 1 is an axial section of part of a first penetrator according to the invention with a portion thereof broken away.
Figure 2:
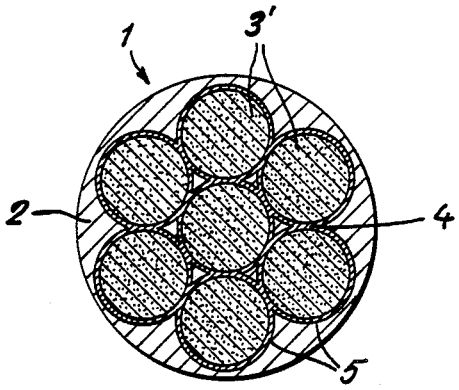
FIG. 2 is a section taken along the line II—II of FIG. 1.

The first embodiment of the penetrator according to the present invention, best seen in FIGS. 1 and 2, is represented at 1 and comprises a casing 2 of generally rod shape in which the partial cores 3' of a material of comparatively higher density are disposed.

The partial cores 3' are of circular cross section and are enclosed in cylindrical thin-wall sheaths which are interconnected at 4 to form a unitary sheath body which separates the partial cores from one another with partitions having the sheath thickness.

Figure 3:
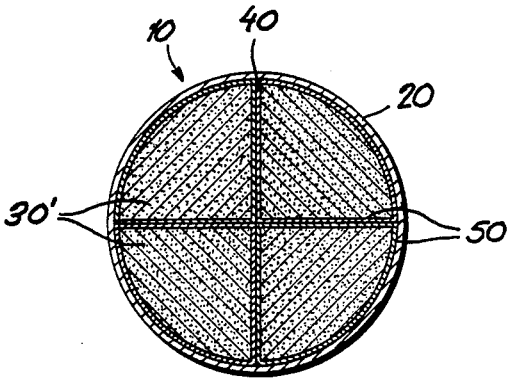
FIG. 3 is a section similar to FIG. 2 but illustrating a second embodiment of the invention.

In the penetrator of the second embodiment represented at 10 in FIG. 3, the core is subdivided along axial planes into cylindrical segments corresponding to four quadrants. Each partial core 30' is surrounded by a thin wall sheath and two such sheaths as shown at 40 form partitions spacing apart the partial cores. The partial cores with their respective sheaths are embedded in a casing 20 which corresponds to the casing 2 of FIGS. 1 and 2, the latter filling the interstices between the sheaths of the cores as well.

A crack in one of the partial cores 3', 30' can run transversely only until it meets a boundary layer 5 at the junction between a sheath and a partial core, the boundary layers being shown at 50 for the second embodiment.

Thus even if one partial core tends to separate into two axial sections, this separation or subdivision is not transmitted to the other partial core and the penetrating ability of the device is largely maintained.

It has been found to be advantageous to make the material of the casing 2, 20 and/or the sheath 4, 40 such that its strength/loss temperature is different from that of the core which can be composed of sintered tungsten particles. For multilayer armoring of tanks and the like the penetration occurs initially at an outer armor layer at a temperature between 1200° C. and 1500° C. If the casing or the sheath loses its strength at a higher temperature than the core, the penetrator deteriorates from the inside out which has been found to be particularly advantageous when the pre-armor comprises brittle materials such as ceramic layers. When, however, the material of the casing 2, 20 and/or the sheath 4, 40 loses its strength at a lower temperature than the material of the core, the decomposition of the penetrator takes place from the outside in which has been found to be particularly effective with high-ductility and tough pre-armoring materials.

In either case, the decomposition of the material having the lower strength-loss temperature should commence at a temperature in the range of 1200° C. to 1500° C.

Figure 4:
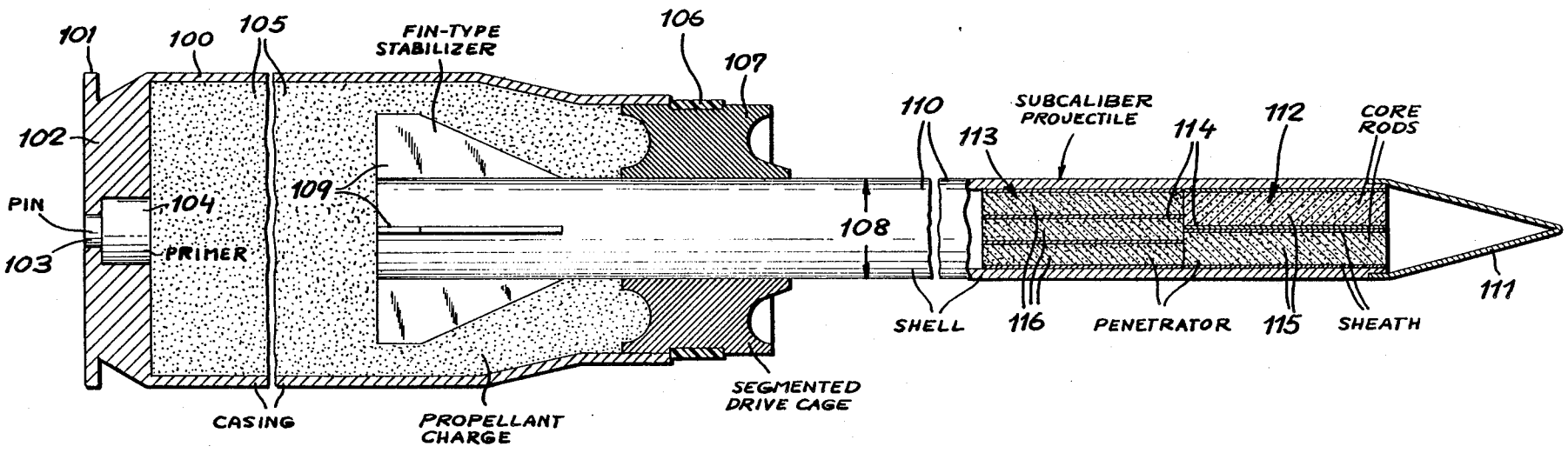
FIG. 4 is a diagrammatic sectional view, partly in elevation, showing a projectile provided with a penetrator according to the invention.

In FIG. 4, the projectile 110 is shown to have a low-mass readily destroyed conical nose piece 111 followed by a pair of penetrators 112 and 113 while the balance of the projectile can carry an explosive charge or further impact or inertial cores.

The core rods 115 of the first penetrator 112 are individually sheathed by material at 114 while the core rods 116 of the second penetrator 113 merely have separating layers 114 interposed between the rods.

The outer diameter 108 of the subcaliber projectile 110 is less than the diameter of the bore of the barrel of the weapon from which the projectile is fired.

The projectile 110 may be provided with a releasable drive cage 107 temporarily held around the projectile by a band 106.

The drive cage is held in the mouth of a shell whose casing is shown at 100 and receives a propellant 105. The propellant charge 105 is fired by a primer 104 with the detonation initiated by a pin 103 in the base 102 of the shell which has an outwardly extending flange 101 engageable by an ejector of the cannon.

The outer diameter of the drive cage 107 corresponds to the core diameter of the weapon.

The rear end of the projectile is formed with a fin-type stabilizer as represented at 109.

The shell carrying the subcaliber projectile 110 is inserted into the magazine of the weapon with the projectile extending into the barrel. When the shell is flred, the propellant charge 105 drives the projectile via its cage 107 through and from the barrel. The air resistance tears away the drive cage 107 as described in the aforementioned application to allow ballistic travel of the projectile to the armored target. Upon impact against the target, the penetrators, by virtue of their high kinetic energy, break the armor in the usual manner and allow destruction of the armored vehicle.

I claim:

1. In a fin-stabilized subcaliber projectile having an elongated inertial impact body, stabilizing fins at one end thereof, and an armor penetrator at the opposite end thereof, the improvement wherein said armor penetrator is capable of penetrating multilayer armor and comprises:

a metal casing;

a core of substantially higher density than that of the casing received in said casing, said core being elongated and being subdivided longitudinally into a multiplicity of elongate core parts; and a boundary layer interposed between said parts and separating them from one another while impeding crack propagation from one core part to another.

2. The improvement defined in claim 1 wherein each of said core parts is surrounded by a sheath, at least one of said sheaths forming said boundary layer.

3. The improvement defined in claim 2 wherein the material of said boundary layer is the same as the material of said casing.

4. The improvement defined in claim 2 wherein the material of said boundary layer is different from the material of said casing.

5. The improvement defined in claim 2 wherein the material of said casing is more ductile than the material of said core.

6. The improvement defined in claim 2 wherein the material of said boundary layer is more ductile than the material of said core.

7. The improvement defined in claim 2 wherein the material of said casing has a strength-loss temperature different from that of the material of said core.

8. The improvement defined in claim 7 wherein the material of said casing has a strength-loss temperature which is lower than that of the material of said core.

9. The improvement defined in claim 2 wherein the material of said sheath has a different strength-loss temperature from that of the material of said core.

10. The improvement defined in claim 8 wherein the material of said sheath has a lower strength-loss temperature than the material of said core.

* * * * *